US005975299A

United States Patent [19]

Weder et al.

[11] Patent Number: 5,975,299

[45] **Date of Patent: *Nov. 2, 1999**

2

[54] WRAPPING MATERIAL HAVING A REINFORCING ELEMENT

[75] Inventors: Donald E. Weder; Joseph G. Straeter, both of Highland, Ill.

[73] Assignee: Southpac Trust International, Inc.

[ * ] Notice: This patent is subject to a terminal disclaimer.

[21] Appl. No.: 08/452,911

[22] Filed: May 30, 1995

Related U.S. Application Data

[63] Continuation of application No. 08/327,854, Oct. 24, 1994, abandoned, and a continuation-in-part of application No. 08/188,183, Jan. 28, 1994, Pat. No. 5,388,386, application No. 08/253,648, Jun. 3, 1994, abandoned, application No. 08/108,093, Aug. 17, 1993, Pat. No. 5,472,952, application No. 08/270,071, Jul. 1, 1994, Pat. No. 5,467,575, and application No. 08/046,504, Apr. 12, 1993, abandoned, said application No. 08/327,854, is a continuation-in-part of application No. 08/121,968, Sep. 14, 1993, abandoned, which is a continuation of application No. 07/953,434, Sep. 29, 1992, abandoned, which is a continuation of application No. 07/687,701, Apr. 18, 1991, abandoned, which is a continuation-in-part of application No. 07/649,263, Jan. 30, 1991, abandoned, which is a continuation of application No. 07/248,960, Sep. 26, 1988, abandoned, which is a continuation-in-part of application No. 07/219,083, Jul. 13, 1988, Pat. No. 4,897,031, which is a continuation of application No. 07/004,275, Jan. 5, 1987, Pat. No. 4,773,182, which is a continuation of application No. 06/613,080, May 22, 1984, abandoned, which is a continuation-in-part of application No. 08/188,183, Jan. 28, 1994, Pat. No. 5,388,386, which is a continuation of application No. 07/968,798, Oct. 30, 1992, Pat. No. 5,369,934, which is a continuation of application No. 07/865,563, Apr. 9, 1992, Pat. No. 5,245,814, which is a continuation of application No. 07/649,379, Jan. 31, 1991, Pat. No. 5,111,638, which is a continuation of application No. 07/249,761, Sep. 26, 1988, abandoned, which is a continuation-in-part of application No. 07/219,083, which is a continuation of application No. 07/004,275, which is a continuation of application No. 06/613,080, said application No. 08/253,648, is a continuation of application No. 07/965,585, Oct. 23, 1992, abandoned, which is a continuation of application No. 07/893,586, Jun. 2, 1992, Pat. No. 5,181,364, which is a continuation of application No. 07/707,417, May 28, 1991, abandoned, which is a continuation of application No. 07/502,358, Mar. 29, 1990, abandoned, which is a continuation-in-part of application No. 07/249,761, which is a continuation-in-part of application No. 07/219,083, which is a continuation of application No. 07/004,275, which is a continuation of application No. 06/613,080, said application No. 08/108,093, is a continuation of application No. 08/024,573, Mar. 1, 1993, abandoned, which is a continuation of application No. 07/464,694, Jan. 16, 1990, Pat. No. 5,208,027, which is a continuation of application No. 07/219,083, which is a continuation of application No. 07/004,275, which is a continuation of application No. 06/613,080, said application No. 08/270,071, is a continuation of application No. 07/928,242, Aug. 10, 1992, Pat. No. 5,363,630, which is a continuation-in-part of application No. 07/803,318, Dec. 4, 1991, Pat. No. 5,344,016, which is a continuation-in-part of application No. 07/707,417, which is a continuation of application No. 07/502,358, which is a continuation-in-part of application No. 07/391,463, Aug. 9, 1989, abandoned, which is a continuation-in-part of application No. 07/249,761, said application No. 07/928,242, is a continuation-in-part of application No. 07/687,701, said application No. 08/046,504, is a continuation of application No. 07/842,817, which is a continuation of application No. 07/586,092, Sep. 19, 1990, abandoned, which is a continuation of application No. 07/393,992, Aug. 15, 1989, Pat. No. 4,989,396, which is a continuation-in-part of application No. 07/249,761, which is a continuation-in-part of application No. 07/219,083, which is a continuation of application No. 07/004,275, which is a continuation of application No. 07/613,080.

[51] Int. Cl.[6] ..... B65B 11/02

[52] U.S. Cl. ..... 206/423; 229/87.01

[58] Field of Search ..... 206/423; 229/87.01, 229/87.02; 47/72

[56] References Cited

U.S. PATENT DOCUMENTS

Re. 21,065 5/1939 Copeman ..... 93/2

(List continued on next page.)

FOREIGN PATENT DOCUMENTS 384764 4/1908 France .

(List continued on next page.)

OTHER PUBLICATIONS

Exhibit A—The Simple Solution For Those Peak Volume Periods, Speed Cover®, 1989©, 6 pages, a brochure published by Highland Supply Corp., 1111 Sixth St., Highland, IL 62249.

(List continued on next page.)

*Primary Examiner*—Jacob K. Ackun
*Attorney, Agent, or Firm*—Dunlap, Codding & Rogers, P.C.

[57] ABSTRACT

A wrapping material for wrapping floral groupings and pots having reinforcing elements therein which provide resiliency and strength to the wrapping material. Methods for using a wrapping material having reinforcing elements.

10 Claims, 8 Drawing Sheets

U.S. PATENT DOCUMENTS

| | | | |
|---|---|---|---|
| 314,054 | 3/1885 | Pease et al. . | |
| 557,526 | 3/1896 | Egge . | |
| 732,889 | 7/1903 | Paver . | |
| 754,811 | 3/1904 | Schlichter | 383/119 X |
| 920,313 | 5/1909 | Franklin . | |
| 1,069,675 | 8/1913 | Claussen . | |
| 1,102,499 | 7/1914 | Haist . | |
| 1,446,563 | 2/1923 | Hughes . | |
| 1,525,015 | 2/1925 | Weeks . | |
| 1,708,752 | 4/1929 | Caras . | |
| 1,748,360 | 2/1930 | Millspaugh . | |
| 1,863,216 | 6/1932 | Wordingham . | |
| 1,868,853 | 7/1932 | Sievers . | |
| 1,978,631 | 10/1934 | Herrlinger . | |
| 2,048,123 | 7/1936 | Howard | 229/87 |
| 2,076,450 | 4/1937 | Doty | 47/34 |
| 2,108,741 | 2/1938 | Betner | 229/65 |
| 2,141,484 | 12/1938 | Piglia | 47/28 |
| 2,170,147 | 8/1939 | Lane | 286/56 |
| 2,204,664 | 6/1940 | Clark | 18/56 |
| 2,239,398 | 4/1941 | Palmer | 229/14 |
| 2,260,230 | 10/1941 | Olson | 206/44 |
| 2,278,673 | 4/1942 | Savada et al. | 154/53 |
| 2,355,559 | 8/1944 | Renner | 229/8 |
| 2,367,749 | 1/1945 | Barbieri | 93/60 |
| 2,371,985 | 3/1945 | Freiberg | 206/46 |
| 2,411,328 | 11/1946 | MacNab | 33/12 |
| 2,458,246 | 1/1949 | Brereton | 220/34 |
| 2,482,981 | 9/1949 | Kamrass | 41/13 |
| 2,510,120 | 6/1950 | Leander | 117/122 |
| 2,529,060 | 11/1950 | Trillich | 117/68.5 |
| 2,544,075 | 3/1951 | Ernst et al. | 150/49 |
| 2,573,770 | 11/1951 | Meadow | 150/28 |
| 2,621,142 | 12/1952 | Wetherell | 154/117 |
| 2,622,380 | 12/1952 | Snyder | 53/15 |
| 2,774,187 | 12/1956 | Smithers | 47/41 |
| 2,780,401 | 2/1957 | Stevens | 229/2.5 |
| 2,822,287 | 2/1958 | Avery | 117/14 |
| 2,845,735 | 8/1958 | Werner | 41/10 |
| 2,846,060 | 8/1958 | Yount | 206/58 |
| 2,850,842 | 9/1958 | Eubank, Jr. | 47/58 |
| 2,883,262 | 4/1959 | Borin | 21/56 |
| 2,967,652 | 1/1961 | Canfield et al. | 229/5.5 |
| 2,968,124 | 1/1961 | Coplen | 47/37 |
| 3,013,689 | 12/1961 | Shropshire | 215/100 |
| 3,022,605 | 2/1962 | Reynolds | 47/58 |
| 3,113,712 | 12/1963 | Kindseth | 229/14 |
| 3,130,113 | 4/1964 | Silman | 161/97 |
| 3,148,799 | 9/1964 | Meroney | 220/63 |
| 3,189,502 | 6/1965 | Little | 156/210 |
| 3,215,330 | 11/1965 | Thomas | 229/14 |
| 3,271,922 | 9/1966 | Wallerstein et al. | 53/3 |
| 3,311,288 | 3/1967 | Lemelson | 229/65 |
| 3,316,675 | 5/1967 | Cartwright | 47/37 |
| 3,318,748 | 5/1967 | Hurst | 156/224 |
| 3,409,948 | 11/1968 | Goodwin | 24/16 |
| 3,466,214 | 9/1969 | Polk et al. | 156/216 |
| 3,488,022 | 1/1970 | Vittori | 248/152 |
| 3,508,372 | 4/1970 | Wallerstein et al. | 53/3 |
| 3,514,012 | 5/1970 | Martin | 220/63 |
| 3,542,616 | 11/1970 | Cain et al. | 156/224 |
| 3,681,105 | 8/1972 | Milutin et al. | 117/15 |
| 3,748,781 | 7/1973 | Erling | 47/34.1 |
| 3,757,990 | 9/1973 | Buth | 220/63 R |
| 3,775,932 | 12/1973 | Jenney | 53/22 |
| 3,793,799 | 2/1974 | Howe et al. | 53/32 |
| 3,909,979 | 10/1975 | Perez | 47/55 |
| 3,927,821 | 12/1975 | Dunning | 229/14 |
| 3,962,503 | 6/1976 | Crawford | 428/40 |
| 4,043,077 | 8/1977 | Stonehocker | 47/66 |
| 4,054,697 | 10/1977 | Reed et al. | 428/40 |
| 4,118,890 | 10/1978 | Shore | 47/28 |
| 4,170,618 | 10/1979 | Adams | 264/101 |
| 4,216,620 | 8/1980 | Weder et al. | 47/72 |
| 4,280,314 | 7/1981 | Stuck | 53/241 |
| 4,297,811 | 11/1981 | Weder | 47/72 |
| 4,300,312 | 11/1981 | Weder et al. | 47/72 |
| 4,333,267 | 6/1982 | Witte | 47/84 |
| 4,379,101 | 4/1983 | Smith | 264/40.3 |
| 4,380,564 | 4/1983 | Cancio et al. | 428/167 |
| 4,413,725 | 11/1983 | Bruno et al. | 206/45.3 |
| 4,468,424 | 8/1984 | Cartwright | 428/103 |
| 4,488,697 | 12/1984 | Garvey | 248/101 |
| 4,508,223 | 4/1985 | Catrambone | 206/423 |
| 4,546,875 | 10/1985 | Zweber | 206/0.82 |
| 4,640,079 | 2/1987 | Stuck | 53/390 |
| 4,733,521 | 3/1988 | Weder et al. | 53/580 |
| 4,765,464 | 8/1988 | Ristvedt | 206/0.82 |
| 4,773,182 | 9/1988 | Weder et al. | 47/72 |
| 4,897,031 | 1/1990 | Weder | 425/388 |
| 4,915,996 | 4/1990 | Curry | 428/40 |
| 4,989,396 | 2/1991 | Weder et al. | 206/423 X |
| 4,996,822 | 3/1991 | Truppe | 53/213 |
| 5,033,232 | 7/1991 | Vaughn | 47/72 |
| 5,111,638 | 5/1992 | Weder | 53/397 |
| 5,181,364 | 1/1993 | Weder | 53/397 |
| 5,208,027 | 5/1993 | Weder et al. | 425/388 |
| 5,584,392 | 12/1996 | Weder et al. | 206/423 |

FOREIGN PATENT DOCUMENTS

| | | |
|---|---|---|
| 2589436 | 5/1987 | France . |
| 2610604 | 8/1988 | France . |
| 345464 | 2/1917 | Germany . |
| 513971 | 11/1930 | Germany . |
| 1169838 | 5/1964 | Germany . |
| 8802054 | 3/1990 | Netherlands . |
| 1115 | 4/1887 | Sweden . |
| 274167 | 3/1951 | Switzerland . |
| 560532 | 4/1975 | Switzerland . |

OTHER PUBLICATIONS

Exhibit B—"Speed Sheets® And Speed Rolls," ©1990, 2 pages, a brochure published by Highland Supply Corp., 1111 Sixth St., Highland, IL 62249.

Exhibit C—"A World of Cut Flower and Pot Plant Packaging," Klerk's Plastic Products Manufaturing Inc. Brochure, date unknown, 6 pages. Applicants admits that the products described in this brochure have been on sale at least more than one year prior to the filing of the present patent application.

WRAPPING MATERIAL HAVING A REINFORCING ELEMENT

CROSS-REFERENCE TO RELATED APPLICATIONS

This application is a continuation of U.S. Ser. No. 08/327,854, filed Oct. 24, 1994, entitled WRAPPING MATERIAL HAVING A REINFORCING ELEMENT AND METHOD, now abandoned; which is a continuation-in-part of U.S. Ser. No. 08/121,968, filed Sep. 14, 1993, entitled WRAPPING MATERIAL HAVING A SHAPE SUSTAINING ELEMENT AND METHOD, now abandoned; which is a continuation of U.S. Ser. No. 07/953,434, filed Sep. 29, 1992, entitled WRAPPING MATERIAL HAVING A SHAPE SUSTAINING ELEMENT AND METHOD, now abandoned; which is continuation of U.S. Ser. No. 07/687,701, filed Apr. 18, 1991, entitled WRAPPING MATERIAL HAVING A SHAPE SUSTAINING ELEMENT AND METHOD, now abandoned; which is a continuation-in-part of U.S. Ser. No. 07/649,263, filed Jan. 30, 1991, entitled FLEXIBLE VASE, now abandoned; which is a continuation of U.S. Ser. No. 248,960, filed Sep. 26, 1988, entitled FLEXIBLE VASE, now abandoned; which is a continuation-in-part of U.S. Ser. No. 219,083, filed Jul. 13, 1988, entitled ARTICLE FORMING SYSTEM, now U.S. Pat. No. 4,897,031, issued Jan. 30, 1990; which is a continuation of U.S. Ser. No. 07/004,275, filed Jan. 5, 1987, entitled ARTICLE FORMING SYSTEM, now U.S. Pat. No. 4,773,182, issued Sep. 27, 1988; which is a continuation of U.S. Ser. No. 06/613,080, filed May 22, 1984, entitled ARTICLE FORMING SYSTEM, now abandoned.

This application is also a continuation-in-part of U.S. Ser. No. 08/188,183, filed Jan. 28, 1994, entitled METHOD FOR WRAPPING AN OBJECT WITH AN EMBOSSED MATERIAL HAVING ADHESIVE THEREON, now U.S. Pat. No. 5,388,386, issued Feb. 14, 1995; which is a continuation of U.S. Ser. No. 07/968,798, filed Oct. 30, 1992, entitled METHOD AND APPARATUS FOR COVERING PORTIONS OF AN OBJECT WITH A SHEET OF MATERIAL HAVING A PRESSURE SENSITIVE ADHESIVE COATING APPLIED TO AT LEAST A PORTION OF AT LEAST ONE SURFACE OF THE SHEET OF MATERIAL, now U.S. Pat. No. 5,369,934, issued Dec. 6, 1994; which is a continuation of Ser. No. 07/865,563, filed Apr. 9, 1992, entitled METHODS FOR WRAPPING A FLORAL GROUPING, now U.S. Pat. No. 5,245,814, issued Sep. 21, 1993; which is a continuation of U.S. Ser. No. 07/649,379, filed Jan. 31, 1991, entitled METHOD FOR WRAPPING AN OBJECT WITH A MATERIAL HAVING PRESSURE SENSITIVE ADHESIVE THEREON, now U.S. Pat. No. 5,111,638, issued May 12, 1992; which is a continuation of U.S. Ser. No. 07/249,761, filed Sep. 26, 1988, entitled METHOD FOR WRAPPING AN OBJECT WITH A MATERIAL HAVING PRESSURE SENSITIVE ADHESIVE THEREON, now abandoned; which is a continuation-in-part of U.S. Ser. No. 219,083, filed Jul. 13, 1988, entitled ARTICLE FORMING SYSTEM, now U.S. Pat. No. 4,897,031, issued Jan. 30, 1992; which is a continuation of U.S. Ser. No. 004,275, filed Jan. 5, 1987, entitled ARTICLE FORMING SYSTEM, now U.S. Pat. No. 4,773,182, issued Sep. 27, 1988; which is a continuation of U.S. Ser. No. 613,080, filed May 22, 1984, entitled ARTICLE FORMING SYSTEM, now abandoned.

This application is also a continuation-in-part of U.S. Ser. No. 08/253,648, filed Jun. 3, 1994, entitled WRAPPING A FLORAL GROUPING WITH SHEETS HAVING ADHESIVE OR COHESIVE MATERIAL APPLIED THERETO, now abandoned; which is a continuation of U.S. Ser. No. 07/965,585, filed Oct. 23, 1992, entitled WRAPPING A FLORAL GROUPING WITH SHEETS HAVING ADHESIVE OR COHESIVE MATERIAL APPLIED THERETO, now abandoned; which is a continuation of U.S. Ser. No. 07/893,586, filed Jun. 2, 1992, entitled WRAPPING A FLORAL GROUPING WITH SHEETS HAVING ADHESIVE OR COHESIVE MATERIAL APPLIED THERETO, now U.S. Pat. No. 5,181,364, issued Jan. 26, 1993; which is a continuation of U.S. Ser. No. 07/707,417, filed May 28, 1991, entitled WRAPPING A FLORAL GROUPING WITH SHEETS HAVING ADHESIVE OR COHESIVE MATERIAL APPLIED THERETO, now abandoned; which is a continuation of U.S. Ser. No. 07/502,358, filed Mar. 29, 1990, entitled WRAPPING A FLORAL GROUPING WITH SHEETS HAVING ADHESIVE OR COHESIVE MATERIAL APPLIED THERETO, now abandoned; which is also a continuation-in-part of U.S. Ser. No. 249,761, filed Sep. 26, 1988, entitled METHOD FOR WRAPPING AN OBJECT WITH A MATERIAL HAVING PRESSURE SENSITIVE ADHESIVE THEREON, now abandoned; which is a continuation-in-part of U.S. Ser. No. 219,083, filed Jul. 13, 1988, entitled ARTICLE FORMING SYSTEM, now U.S. Pat. No. 4,897,031, issued Jan. 30, 1990; which is a continuation of U.S. Ser. No. 004,275, filed Jan. 5, 1987, entitled ARTICLE FORMING SYSTEM, now U.S. Pat. No. 4,773,182, issued Sep. 27, 1988; which is a continuation of U.S. Ser. No. 613,080, filed May 22, 1984, entitled ARTICLE FORMING SYSTEM, now abandoned.

This application is also a continuation-in-part of U.S. Ser. No. 08/108,093 filed Aug. 17, 1993, entitled ARTICLE FORMING SYSTEM, now U.S. Pat. No. 5,472,752; which is a continuation of U.S. Ser. No. 08/024,573, filed Mar. 1, 1993, entitled ARTICLE FORMING SYSTEM, now abandoned; which is a continuation of Ser. No. 07/464,694, filed Jan. 16, 1990, entitled ARTICLE FORMING SYSTEM, now U.S. Pat. No. 5,208,027, issued May 4, 1993; which is a continuation of U.S. Ser. No. 219,083, filed Jul. 13, 1988, entitled ARTICLE FORMING SYSTEM, now U.S. Pat. No. 4,897,031, issued Jan. 30, 1990; which is a continuation of U.S. Ser. No. 004,275, filed Jan. 5, 1987, entitled ARTICLE FORMING SYSTEM, now U.S. Pat. No. 4,773,182, issued Sep. 27, 1988; which is a continuation of U.S. Ser. No. 613,080, filed May 22, 1984, entitled ARTICLE FORMING SYSTEM, now abandoned.

This application is also a continuation-in-part of U.S. Ser. No. 08/270,071, filed Jul. 1, 1994, entitled "METHOD FOR WRAPPING A FLORAL GROUPING WITH A SHEET OF MATERIAL HAVING A REINFORCING MEMBER", now U.S. Pat. No. 5,467,575; which is a continuation of U.S. Ser. No. 07/928,242, filed Aug. 10, 1992, entitled "FLORAL GROUPING WRAPPER WITH REINFORCING MEMBER", now U.S. Pat. No. 5,363,630; which is a continuation-in-part of U.S. Ser. No. 07/803,318, filed Dec. 4, 1991, entitled "WRAPPING MATERIAL FOR WRAPPING A FLORAL GROUPING HAVING STAGGERED STRIPS OF ADHESIVE MATERIAL APPLIED THERETO AND METHOD", now U.S. Pat. No. 5,344,016; which is a continuation-in-part of U.S. Ser. No. 07/707,417, filed May 28, 1991, entitled "WRAPPING A FLORAL GROUPING WITH SHEETS HAVING ADHESIVE OR COHESIVE MATERIAL APPLIED THERETO", now abandoned; which is a continuation of U.S. Ser. No. 07/502,358, filed Mar. 29, 1990, entitled "WRAPPING A FLORAL GROUPING WITH SHEETS HAVING ADHESIVE OR COHESIVE MATERIAL APPLIED THERETO", now abandoned; which is a continuation-in-part of U.S. Ser. No. 07/391,463, filed Aug. 9, 1989, entitled "ADHESIVE APPLICATOR DISPENSER", now abandoned; which is a continuation-in-part of U.S. Ser. No. 07/249,761, filed Sep. 26, 1988, entitled "METHOD FOR WRAPPING AN OBJECT WITH A MATERIAL HAVING PRESSURE SENSITIVE ADHESIVE THEREON", now abandoned.

Said application Ser. No. 07/928,242 is also a continuation-in-part of U.S. Ser. No. 07/687,701, filed Apr. 18, 1991, entitled "WRAPPING MATERIAL HAVING A SHAPE SUSTAINING ELEMENT AND METHOD", now abandoned.

This application is also a continuation-in-part of U.S. Ser. No. 08/046,504, filed Apr. 12, 1993, entitled "CURL WRAP AND METHODS FOR USING SAME", now abandoned; which is a continuation of U.S. Ser. No. 07/842,817, filed Feb. 27, 1992, entitled "CURL WRAP AND METHODS FOR USING SAME", now abandoned; which is a continuation of U.S. Ser. No. 07/586,092, filed Sep. 19, 1990, entitled "CURL WRAP AND METHODS FOR USING SAME", now abandoned; which is a continuation of U.S. Ser. No. 07/393,992, filed Aug. 15, 1989, entitled "CURL WRAP AND METHODS FOR USING SAME", now U.S. Pat. No. 4,989,396; which is a continuation-in-part of U.S. Ser. No. 249,761, filed Sep. 26, 1988, entitled "METHOD FOR WRAPPING AN OBJECT WITH A MATERIAL HAVING PRESSURE SENSITIVE ADHESIVE THEREON", now abandoned; which is a continuation-in-part of U.S. Ser. No. 219,083, filed Jul. 13, 1988, entitled "ARTICLE FORMING SYSTEM", now U.S. Pat. No. 4,897,031; which is a continuation of U.S. Ser. No. 004,275, filed Jan. 5, 1987, entitled "ARTICLE FORMING SYSTEM", now U.S. Pat. No. 4,773,182; which is a continuation of U.S. Ser. No. 613,080, filed May 22, 1984, entitled "ARTICLE FORMING SYSTEM", now abandoned.

FIELD OF THE INVENTION

This invention generally relates to wrapping materials and, more particularly, to wrapping materials having reinforcing elements, and methods of using same.

DESCRIPTION OF THE PREFERRED EMBODIMENTS

The Embodiments and Methods of FIGS. 1–7

Commonly in the floral industry, wrapping materials are utilized to wrap about floral groupings. In some instances, the wrapping material enhances the aesthetic appearance of the floral grouping. The same wrapping materials are also used to protect the floral grouping from damage when moved or shipped.

A disadvantage exists, however, in utilizing some wrapping materials to protect a floral grouping from damage. Some wrapping materials are constructed as extremely thin sheets of material. Such thin sheets of material are often inadequate to protect a fragile floral grouping, and, especially, the delicate blooms therein, from being crushed or otherwise damaged during shipment and/or delivery to a recipient.

The present invention contemplates a wrapping material which has reinforcing elements connected to a sheet of material. Such reinforcing elements impart adequate strength and resiliency to the flexible wrapping material, enabling the wrapping material to both wrap and protect a floral grouping during shipment or delivery. Such protection permits the floral grouping, and, especially, the delicate blooms contained therein, to remain spaced a distance away from the walls of the shipping box or carton during shipment and/or delivery, thereby preventing damage to the floral grouping (especially the blooms), and permitting the floral grouping to maintain an attractive and marketable appearance to prospective customers or recipients.

The reinforcing elements of the present invention may also be provided on a wrapping material in an arbitrary and random fashion. That is, there is no distinct pattern to the reinforcing elements. In this manner, some reinforcing elements may overlap, while others do not. In an alternative pattern, there is no substantial overlap of the reinforcing elements. In still a further pattern, a substantial portion of the reinforcing elements overlap, but in an arbitrary, random pattern. It will be understood that in still yet another pattern, any of the above-referenced patterns may occur in any portion or combination of portions of the wrapping material.

It will be appreciated that the overlapping (also referred to herein as exchangeably as "interconnecting") reinforcing elements will cooperate, when connected to a sheet of material, to permit the sheet of material both to be formed about an item and to retain the formed shape.

The wrapping material having reinforcing elements disposed in an arbitrary and random pattern is used to wrap a floral grouping, forming a wrapper thereabout. Said wrapping material is used to substantially wrap the outer peripheral surface of a flower pot as well, thereby forming a wrapper. In this instance, the wrapper comprises a decorative cover. Said wrapping material may also form a wrapper which comprises a decorative plant cover, wherein such a wrapper may function as a temporary or permanent container for a plant of floral grouping.

Figure 1:
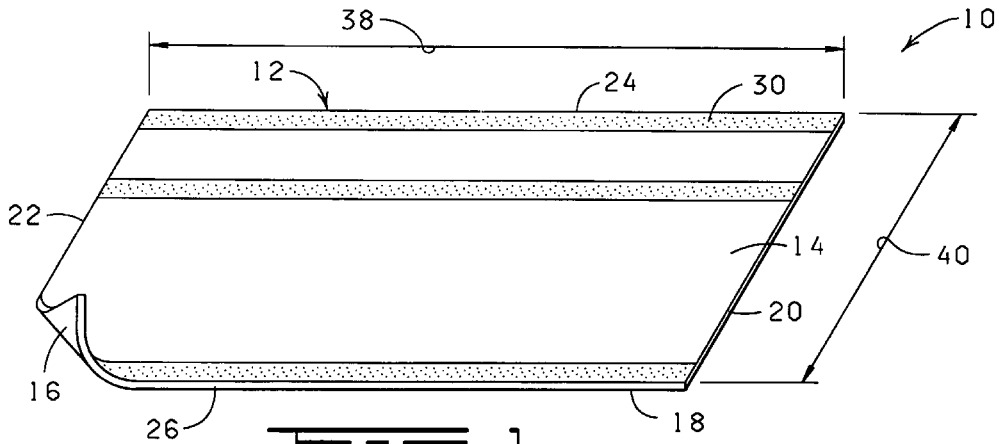
FIG. 1 is a perspective view of the embodiment of the wrapping material of the present invention, showing the upper surface of the wrapping material, the upper surface having a plurality of strips of bonding material disposed thereon, one corner turned up to show the lower surface for illustration purposes only.
Figure 2:
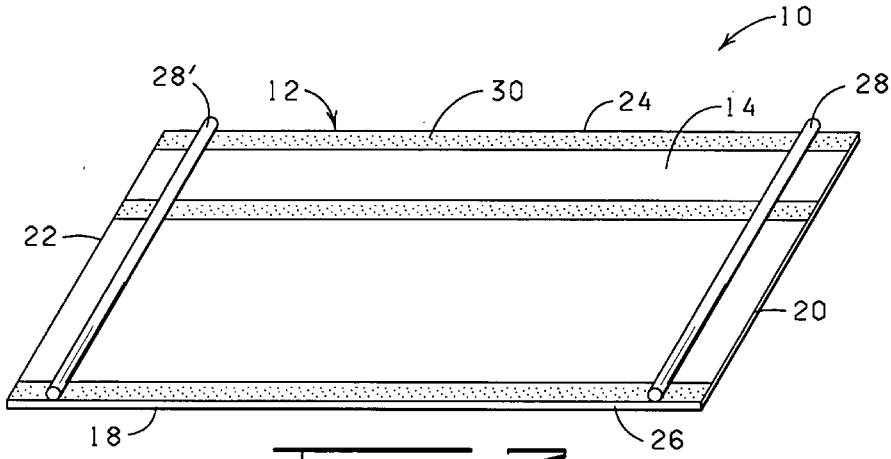
FIG. 2 is a perspective view of the embodiment of FIG. 1, but showing two reinforcing elements disposed on the upper surface of the sheet of material.

Referring now to FIGS. 1–2, designated generally by the reference numeral 10 is a wrapping material which is constructed in accordance with the present invention. The wrapping material 10 comprises at least one sheet of material 12. The sheet of material 12 has an upper surface 14, a lower surface 16 (one edge of the sheet of material lifted for illustration purposes only), and an outer periphery 18. In the embodiment shown in FIG. 1, the outer periphery 18 of the sheet of material 12 comprises a first side 20, a second side 22, a third side 24, and a fourth side 26. It will be appreciated, however, that the sheet of material 12 may comprise a variety of shapes, including, but not limited to, square, round, geometric, non-geometric, asymmetric and/or fanciful shapes.

The sheet of material 12 also comprises one or more reinforcing elements 28 (only one reinforcing element designated by the numeral 28). "Reinforcing elements" means wire, rods, or strips made of metal (such as, but not by way of limitation, steel or aluminum), plastic, such as synthetic resinous plastic for example, plastic straws, or thin strips of plastic, cardboard, posterboard, reeds, bamboo, wood, corrugated film, that is, corrugating a portion of one or more sheets of material 12 and laminating the corrugated portion to a flat, non-corrugated portion of the sheet of material 12 or any combination thereof which imparts sufficient strength to permit a sheet of material 12 having one or more reinforcing elements 28 attached thereto to protect a floral grouping 32 wrapped therein from being easily crushed, for example, in a shipping box or being damaged by wind when being delivered to a recipient.

The reinforcing element 28 functions to impart reinforcing properties to the sheet of material 12. "Reinforcing properties" means that after the element 28 is disposed on and/or incorporated in the non-reinforced sheet of material 12, the sheet of material 12 is reinforced and strengthened, and will sustain a shape (substantially "shape sustaining") sufficient to greatly reduce or eliminate damage to a floral grouping 30 wrapped therein, or, in circumstances described in detail below, to sustain a wrapped shape around an object, such as, but not by way of limitation, a flower pot.

The reinforcing elements 28 may have a circular cross-section, or a non-circular cross-section made from any material described above that can impart reinforcing properties to the sheet of material 12. The reinforcing member may be solid, or may have air disposed within at least a portion thereof (such as occurs in corrugated sheet materials), or can be tube-shaped, or the reinforcing element can comprise any geometric or non-geometric shape, or any combination thereof. Further, the reinforcing element 28 in one embodiment may extend outward, beyond the outer periphery 18 of the sheet of material 12 to which it is attached (not shown).

Such a reinforcing element 28 may also comprise a plurality of reinforcing elements 28, such as a plurality of short metal and/or plastic wires which are connected to the sheet of material 12. In one such embodiment, a portion of the reinforcing elements 28 may interconnect. Alternatively, the reinforcing elements 28, while in contact with a portion of the surrounding reinforcing elements 28, may not interconnected, but may just overlap.

In a further alternative, the reinforcing elements 28 are constructed such that the reinforcing elements 28 maintain their original shape, and are not readily bendable or shapeable. Such reinforcing elements 28 do impart their strength and rigidity, however, to a sheet of material 12 when connected thereto, again creating a sheet of material 12 which is capable of protecting and preventing damage to a floral grouping contained therein via increased strength and resiliency (or contained within a pot wrapped with such a wrapping material 10) when such a floral grouping is shipped, handled, and/or delivered.

At least a portion of the reinforcing element 28 may have "springy" properties. "Springy properties" is defined as a reinforcing element having a specific preformed shape which causes the reinforcing element to revert back to its pre-determined, preformed shape after the wire is incorporated into the sheet of material 12.

Alternatively, at least a portion of the reinforcing element 28 may comprise a non-preformed, pliable reinforcing element. "Non-preformed, pliable" is defined as a reinforcing element having no pre-determined, preformed shape, and when incorporated into the sheet of material 12, forms no specific shape until wrapped or folded into a specific shape about the floral grouping. Such "non-preformed, pliable" characteristics may be used interchangeably herein with the term "deadfold" characteristics.

The reinforcing element 28 may have shape sustaining properties. "Shape sustaining" as used herein means that when the reinforcing element 28 is connected to the sheet of material 12, the reinforcing element and/or the sheet of material 12 is capable of sustaining the wrapped shape when wrapped about an item, such as a floral grouping or flower pot. It will be appreciated that when a reinforcing element 28 having, for example but not by way of limitation, deadfold or springy characteristics, is connected to the sheet of material 12 to form the wrapping material 10, such a wrapping material 10 will retain its wrapped shape when wrapped about an object until said wrapping material 10 is unwrapped from the object, said wrapping material 10 capable of re-use for wrapping an identical or different object in a different wrapped shape, the wrapping material 10 again retaining said new wrapped shape. It will be appreciated that the sheet of material 12, depending upon its composition, may also have some degree of shape sustaining properties.

In a further alternative, the reinforcing element 28 may have rigid properties. "Rigid properties" means that the reinforcing element resists bending or shaping and retains a reasonable amount of rigidity and stiffness. This rigidity and stiffness permit the reinforcing element 28 attached to the sheet of material 12 to provide an amount of resistance against outside pressures, to protect a floral arrangement wrapped therein. In still a further alternative, the reinforcing element 28 may have more than one property or characteristic defined herein.

The reinforcing element 28 is connected to the sheet of material 12 by disposing the reinforcing element 28 on the sheet of material 12 or by incorporating the reinforcing element 28 in the sheet of material 12. When the reinforcing element 28 is disposed on the sheet of material 12, the reinforcing element 28 may be connected to the sheet of material 12 via a bonding material 30. The reinforcing element 28 may be bonded to a surface of the sheet of material 12, or may be laminated to the sheet of material 12. The reinforcing element 28 further may be connected to the sheet of material 12 by disposing the reinforcing element 28 between two or more sheets of material 12 and laminating the sheets of material 12 together. The reinforcing element 28 may be stitched to the sheet of material 12, stapled to the sheet of material 12, and/or threaded through the sheet of material 12 via preformed apertures, or apertures formed when the reinforcing element 28 is forced through the wrapping material 10. Further, the reinforcing element 28 may be extruded in the sheet of material 12 which is formed at least partially from a polymer film. Both incorporation of materials in extruded film, and the extrusion of polymer film, is well known in the art.

The bonding material 30 may be disposed on the upper surface 14 of the sheet of material 12, or, alternatively, on any other surface of any sheets of material 12 described herein. The bonding material 30 may be applied as a strip or as spots or other shapes.

One method for disposing a bonding material 30, in this case an adhesive, on a sheet of material is described in U.S. Pat. No. 5,111,637 entitled "Method For Wrapping A Floral Grouping" issued to Weder et al., on May 12, 1992 and which is hereby incorporated herein by reference herein. Another method for disposing a bonding material 30 on a sheet of material is described in U.S. Pat. No. 5,111,638, entitled, "Method For Wrapping An Object With A Material Having Pressure Sensitive Adhesive Thereon" issued to D. Weder on May 12, 1992, which is hereby incorporated by reference herein. Still yet another method for disposing a bonding material 30 in order to laminate two sheets of material is described in U.S. Pat. No. 4,297,811 entitled "Laminated Printed Foil Flower Pot Wrap With Multicolor Appearance, issued to Weder on Nov. 3, 1981, which is hereby incorporated by reference herein.

Alternatively, the bonding material 30 may be disposed on the reinforcing elements 28, to connect the reinfocing elements 28 to the sheet of material 12. In a further alternative, the bonding material 30 may be disposed on both the sheet of material 12 and the reinforcing elements to connect the reinforcing elements to the sheet of material 12. And, the reinforcing elements 28 may not be connected to the sheet of material 12 until after the sheet of material 12 is wrapped about an item, such as, but not by way of limitation, a floral grouping or a flower pot.

The term "bonding material" when used herein means an adhesive, preferably a pressure sensitive adhesive, or a cohesive. Where the bonding material is a cohesive, a similar cohesive material must be placed on the adjacent surface for bondingly contacting and bondingly engaging with the cohesive material. The term "bonding material" also includes materials which are heat sealable and, in this instance, the adjacent portions of the material must be brought into contact and then heat must be applied to effect the seal. The term "bonding material" also includes materials which are sonic sealable and vibratory sealable. The term "bonding material" when used herein also means a heat sealing lacquer which may be applied to the material and, in this instance, heat, sound waves, or vibrations, also must be applied to effect the sealing.

The term "bonding material" when used herein also means any type of material or thing which can be used to effect the bonding or connecting of the two adjacent portions of the material or sheet of material to effect the connection or bonding described herein. The term "bonding material" also includes ties, labels, bands, ribbons, strings, tape, staples or combinations thereof. Some of the bonding materials would secure the ends of the material while other bonding material may bind the circumference of a wrapper, or a wrapping material wrapped about a pot, or, alternatively and/or in addition, the bonding materials would secure overlapping folds in the wrapper and/or wrapped pot. Another way to secure the wrapping material is to heat seal the ends of the material to another portion of the material to form the sleeve. One way to do this is to contact the ends with an iron of sufficient heat to heat seal the material.

The term "bonding material" includes a cold seal adhesive. The cold seal adhesive acts similar to a cohesive, that is, the cold seal adhesive binds only to a like substrate, that is, another surface treated with the identical cold seal adhesive. The cold seal adhesive differs from an adhesive, in that a cold seal adhesive does not bond to machinery, equipment, or other non-similar substrates. Further, the cold seal adhesive, once it coheres to a similar substrate, is not readily releasable, as is, for example but not by way of limitation, a pressure sensitive adhesive.

The term "bonding material" when used herein also means any heat or chemically shrinkable material, and static electrical or other electrical means, magnetic means, mechanical or barb-type fastening means or clamps, curl-type characteristics of the film or materials incorporated in material which can cause the material to take on certain shapes, and any type of welding method which may weld portions of the material to itself or to the pot, or to both the material itself and the pot.

At least one reinforcing element 28 is connected to the sheet of material 12. As shown in FIG. 2, however, more than one reinforcing element 28 may be used. The positioning of the reinforcing element 28, the choice of material or combinations of materials for each of the reinforcing elements 28 utilized, and the size and shape of each reinforcing element 28 or combination of reinforcing elements 28 will depend upon the necessary protection desired for the floral grouping or flower pot, the length of time the floral grouping or flower pot is to be packaged, the amount of floral groupings packaged together for shipment of delivery, the type of floral grouping or flower pot, the commercial use of the wrapping materials, as well as the composition of the sheet of material 12.

Figure 5:
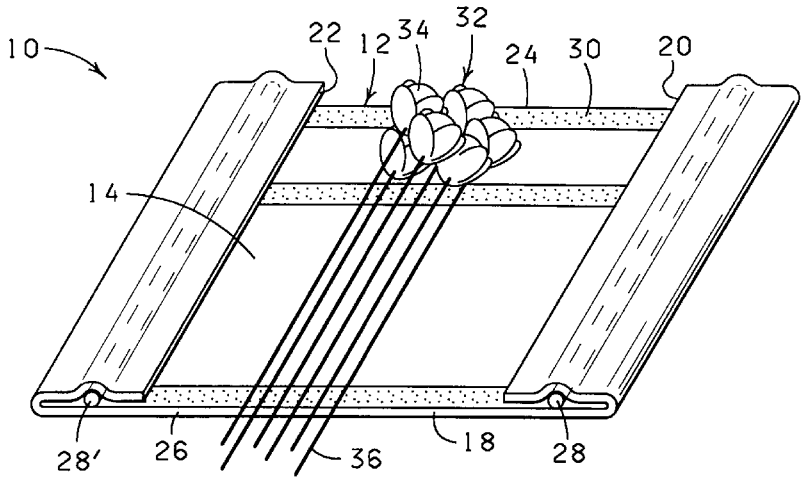
FIG. 5 is a perspective view of the embodiment of FIG. 3, but showing a floral grouping disposed thereon.
Figure 6:
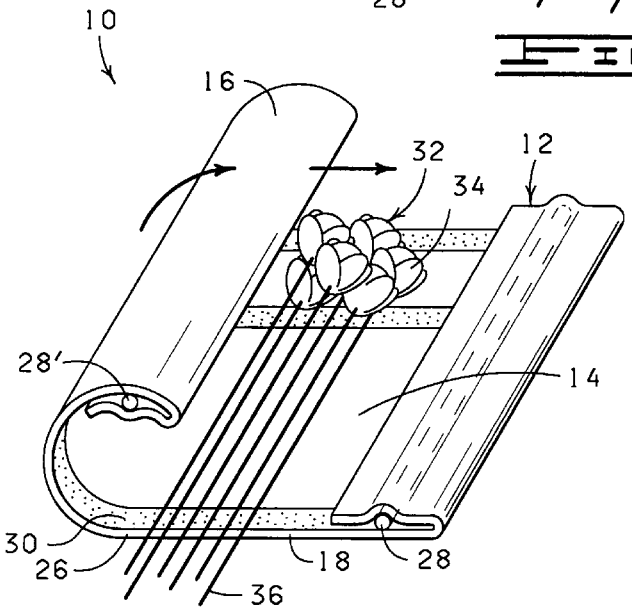
FIG. 6 is a perspective view of the embodiment of FIG. 5, but showing a floral grouping being wrapped.
Figure 7:
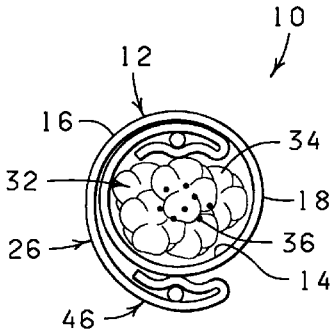
FIG. 7 is a side elevational view of the embodiment of FIG. 6, but showing a wrapped floral grouping.
Figure 8:
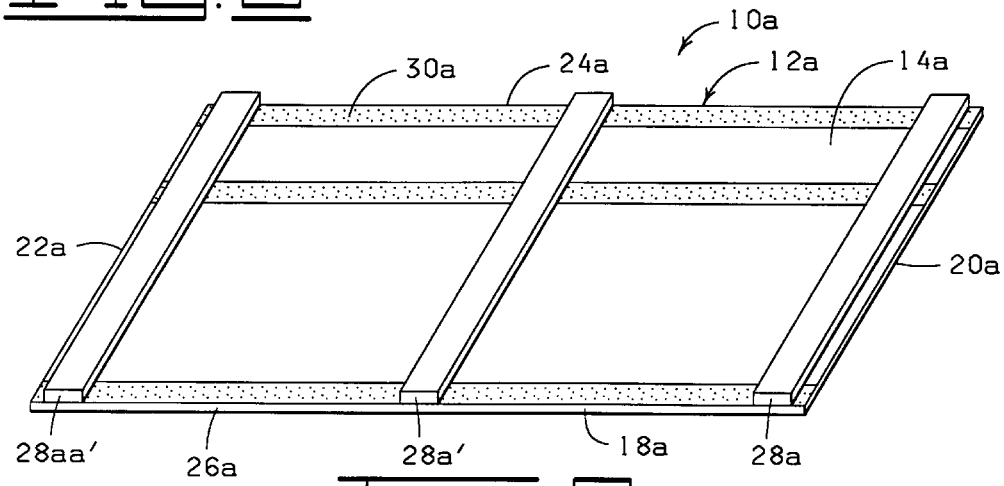
FIG. 8 is a perspective view of another embodiment of the wrapping material having a reinforcing element of the present invention, showing the upper surface with three reinforcing elements disposed thereon.
Figure 9:
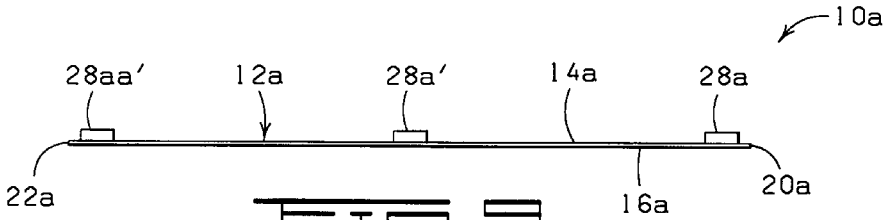
FIG. 9 is a side elevational view of the embodiment of FIG. 8.
Figure 10:
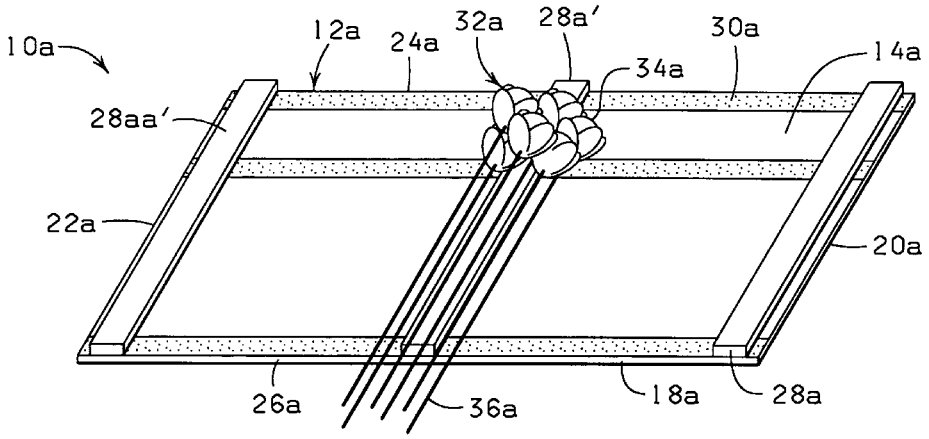
FIG. 10 is a perspective view of the embodiment of FIG. 8, but showing a floral grouping disposed thereon.

The sheet of material 12 is also used to wrap fresh flowers, or a floral grouping 32 (FIGS. 5–6). "Floral grouping" is used herein and means fresh cut flowers, artificial flowers, other fresh and/or artificial plants or other floral materials and may include other secondary plants and/or ornamentation which add to the aesthetics of the overall floral grouping 32. The floral grouping 32 comprises a flower portion 34 which may comprise either a bloom or foliage portion and a stem portion 36. However, it will be appreciate that the floral grouping 32 may consist of only a single bloom or only foliage (not shown).

Referring to FIGS. 1–4, multiple sheets of material 12 may be used. When multiple sheets of material 12 are used, it will be understood that the sheets of material 12 need not be uniform in size or shape. It will further be appreciated that the sheet of material 12 shown in all embodiments herein is substantially flat.

The sheet of material 12 may be constructed of a single sheet of material 12 or a plurality of sheets of material 12. Any thickness of the sheet of material 12 may be utilized in accordance with the present invention as long as the sheet of material 12 may be wrapped about at least a portion of a floral grouping 32, as described herein. The sheet of material 12 has a thickness of about 0.1 mil to about 30 mils. Typically, the sheet of material 12 has a thickness in a range of about 0.1 mils to about 10 mils. Frequently, the sheet of material 12 is constructed from one sheet of polymer film having a thickness in a range of from about 0.1 mils to about 3.5 mils.

The sheet of material 12 is constructed from any suitable material that is capable of being wrapped about a floral grouping 32 or a flower pot. The sheet of material 12 comprises paper (untreated or treated in any manner), cellophane, foil, plastic film, fiber (woven or nonwoven or synthetic or natural), cloth (woven or nonwoven or natural or synthetic), burlap, or any combination thereof.

The term "plastic film," as used herein means any polymer film. For example, but not by way of limitation, one polymer film is a polypropylene film. Another example of a polymer film, but not by way of limitation, is cellophane.

The sheet of material 12 may consist of designs or decorative patterns which are printed, etched, and/or embossed thereon using inks or other printing materials. An example of an ink which may be applied to one or more surfaces of the sheet of material 12 is described in U.S. Pat. No. 5,147,706, entitled, "Water Based Ink On Foil And/Or Synthetic Organic Polymer", issued to Kingman on Sep. 15, 1992 and which is hereby incorporated herein by reference.

The sheet of material 12 may have various colorings, coatings, embossings, flocking and/or metallic finishes, or other decorative surface ornamentation applied separately or simultaneously or may be characterized totally or partially by pearlescent, translucent, transparent, iridescent or the like, qualities. Each of the above-named characteristics may occur alone or in combination and may be applied to the upper surface 14 and/or lower surface 16 of the sheet of material 12. Moreover, each surface of the sheet of material 12 may vary in the combination of such characteristics. The sheet of material 12 may be opaque, translucent, clear, tinted transparent, or any combination thereof.

The bonding material 30 may be used to laminate two or more sheets of material 12 together and may also be tinted or colored by using a dye, pigment, or ink. In this manner, different coloring effects are provided, and the multiple sheets of material 12 may be given a colored appearance by use of a colored bonding material 30. U.S. Pat. No. 5,147,706 described immediately above provides one water based ink which may be used to tint one or more sheets of material 12 or which may be used to tint the bonding material 30.

The sheet of material 12 is often non-reinforcing which means that the sheet of material 12 is incapable of sustaining a shape sufficient to prevent damage to a floral grouping 30 wrapped in such a sheet of material 12 during shipment, when several wrapped floral groupings may be packaged together, or during delivery, when wind, rain, or damage by the deliverer may occur. "Non-reinforcing" is further defined as the sheet of material 12 being incapable of sustaining a wrapped shape about an object, such as a flower pot or floral grouping 32. In other words, the sheet of material 12 has the inherent property of being easily deformed when wrapped about an item.

The sheet of material 12 has a width 38 (FIG. 1) extending generally between the first side 20 and the second side 22, respectively, sufficiently sized whereby the sheet of material 12 can be wrapped about and substantially surround and encompass a floral grouping 32. The sheet of material 12 has a length 40 (FIG. 1) extending generally between the third side 24 and the fourth side 26, respectively, sufficiently sized whereby the sheet of material 12 extends over a substantial portion of the floral grouping 32 when the sheet of material 12 has been wrapped about the floral grouping 32 in accordance with the present invention shown and described in detail herein.

Referring again to FIGS. 2–4, the sheet of material 12 has a plurality of strips of bonding material 30, each strip which extends between the first side 20 and the second side 22 of the sheet of material 12 (only one such strip of bonding material 30 being designated). The sheet of material 12 illustrated in FIGS. 2–7 also comprises a first reinforcing element 28 and a second reinforcing element 28'. The first reinforcing element 28 is disposed near the first side 20 of the sheet of material 12, and extends between the third side 24 and the fourth side 26 of the sheet of material 12. The second reinforcing element 28' is disposed near the second side 22 of the sheet of material 12 and extends between the third side 24 and the fourth side 26 of the sheet of material 12. It will be understood, however, that any number of reinforcing elements 28 may be utilized with any of the embodiments shown and described herein.

Figure 3:
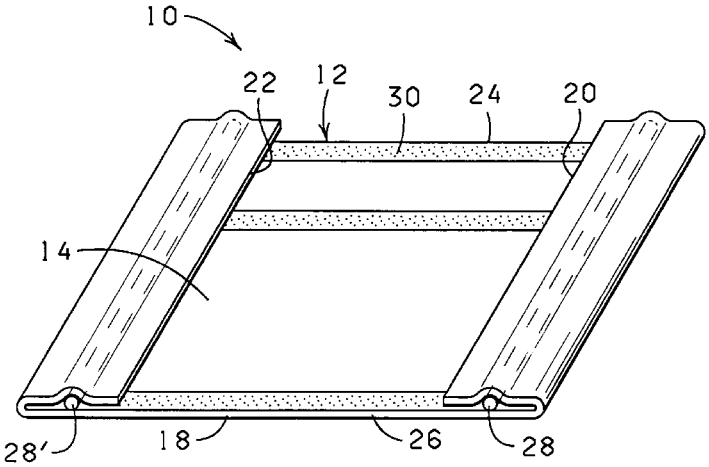
FIG. 3 is a perspective view of the embodiment of FIG. 2, but showing the wrapping material near both the first side and the second side of the sheet of material overlapping the reinforcing elements on the sheet of material.
Figure 4:
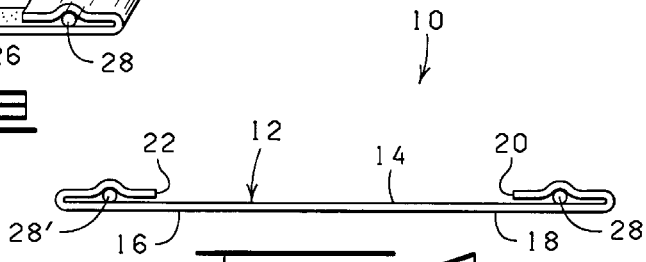
FIG. 4 is a side elevational view of the embodiment of FIG. 3.

As shown in FIGS. 2–4, the first side 20 of the sheet of material 12 overlaps and bondingly connects and secures, via the bonding material 30, the first reinforcing element 28 to the sheet of material 12. In a similar manner, the second side 22 overlaps and bondingly connects and secures the second reinforcing element 28' to the sheet of material 12. It will be appreciated that while a bonding material 30 is shown and utilized in this embodiment to attach the first reinforcing element 28 and the second reinforcing element 28' to the sheet of material 12, any method of connection described herein or known in the art may be utilized to connect any reinforcing element 28 described herein to any sheet of material 12 described herein.

In a general method of use (FIGS. 5–7), the floral grouping 32 is placed on the sheet of material 12, the sheet of material 12 being sized to wrap about and substantially surround and encompass the floral grouping 32. The sheet of material 12 is lifted from one side (illustrated herein as the second side 22) to cover the floral grouping 32. The sheet of material 12 is rolled about the floral grouping 32 in a rolling direction 42 and continued rolled in a general direction 44 until the floral grouping 32 is encompassed in the sheet of material 12 and the sheet of material 12 is wrapped completely about the floral grouping 32. A portion of the sheet of material 12 overlaps at least one other portion of the sheet of material 12. The overlapping portions of the sheet of material 12 are bonded to the sheet of material 12 by their contact with the bonding material 30 on the upper surface 14 which bondingly connects to the overlapping portions of the sheet of material 12, whereby the second side 22 of the sheet of material 12 is bonded to overlapping portions of the sheet of material 12 generally between the third side 24 and the fourth side 26 of the sheet of material 12 whereby there are no loose flaps formed by unbonded portions of the sheet of material 12. The sheet of material 12 substantially encompasses and surrounds a substantial portion of the bloom portion 34 of the floral grouping 32, and may also surround a substantial portion of the stem portion 36 of the floral grouping 32 as well. The sheet of material 12 is held about the floral grouping 32 by the bonding of the overlapping portions of the sheet of material 12. In addition, the sheet of material 12 may also be tightly wrapped about the stem portion 36 of the floral grouping 32. The stem portion 36 of the floral grouping 32 may extend beyond the sheet of material 12. Alternatively, the stem portion 36 may not extend beyond the sheet of material 12. The wrapped sheet of material 12 forms a wrapper 46 about the floral grouping 32. The wrapper 46 has an open upper end 48 and an open lower end with and opening formed therethrough. The bloom portion 34 may extend, at least partially, for example only, from the open upper end 48. Alternatively, and frequently, the bloom portion 34 may be encompassed by the wrapper 46. It will be appreciated that either the open upper end 48 and/or the open lower end 50 of the wrapper 46 may be closed. The open upper end 48 of the wrapper 46 is sometimes loosely wrapped about the bloom portion 34 of the floral grouping 32. In some instances, the wrapper 46 extends beyond the bloom portion 34 to protect the bloom portion 34 from being crushed against a box or carton during shipment. It will be appreciated that any portion of the wrapper 46 may be crimped about the floral grouping 32. Crimping is known in the art.

Figure 11:
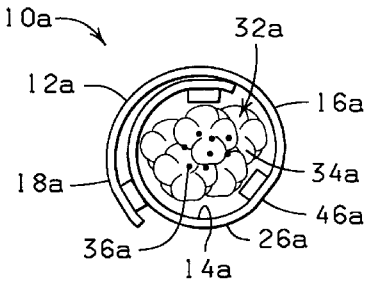
FIG. 11 is a side elevational view of the embodiment of FIG. 10, showing a wrapped floral grouping.
Figure 20:
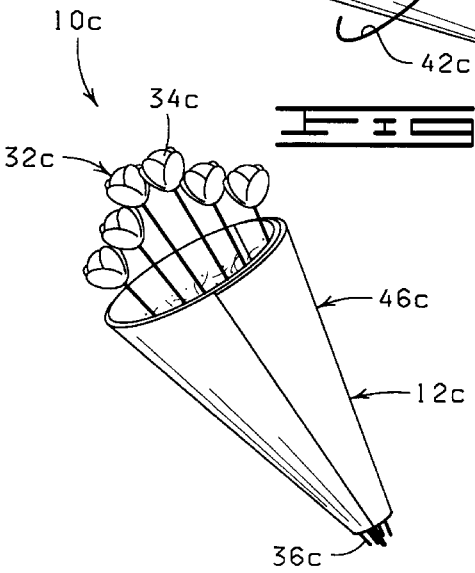
FIG. 20 is a perspective view of the embodiment of FIG. 17, but showing the floral grouping wrapped.
Figure 21:
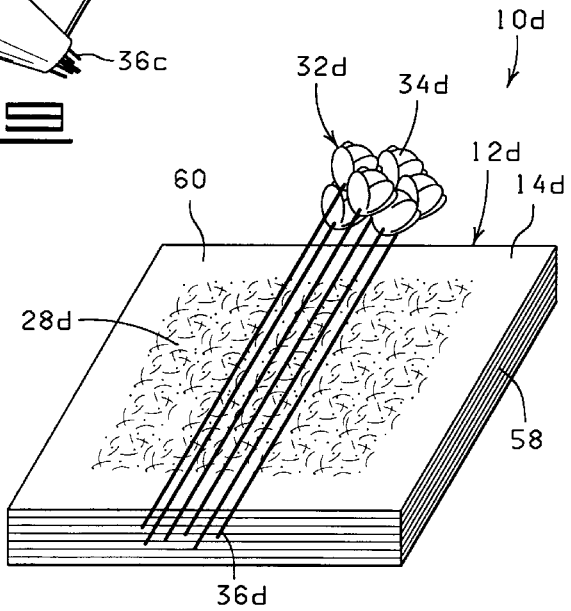
FIG. 21 is a perspective view of the embodiment of FIG. 17, but showing the wrapping material having reinforcing elements in a pad of sheets of material, a floral grouping disposed on the top sheet of the pad of sheets of material.

The sheet of material 12 wrapped about the floral grouping 32 forms a wrapper 46 which may be a cylindrically shaped wrapper 46 (FIGS. 7, 11–12) or which may be a conically-shaped wrapping (FIG. 20). It will be appreciated that the wrapper 46 may comprise other geometric, non-geometric, asymmetric and/or fanciful form.

The Embodiments and Methods of FIGS. 8–12

FIGS. 8–12 illustrate another embodiment and method of use of the present invention. The wrapping material 10*a* showing this embodiment and used in this method is constructed exactly the same as the wrapping material 10 shown in FIGS. 1–7 and described in detail previously except that the location of the strips of bonding material 30*a* varies slightly (the middle strip of the plurality of strips of bonding material 30*a* being disposed nearer the third side 24*a* of the sheet of material 12*a*, only one strip of bonding material 30*a* being designated), three separate reinforcing elements are disposed on the sheet of material, namely, a first reinforcing element 28*a*, a second reinforcing element 28*a*' and a third reinforcing element 28*aa*', and the first end 20*a* and the second end 22*a* of the sheet of material do not overlap.

The first reinforcing element 28*a* is disposed near the first side 20*a* of the sheet of material 12*a*, and extends between the third side 24*a* and the fourth side 26*a* of the sheet of material 12*a*. The second reinforcing element 28*a*' is disposed in a location generally halfway between the first side 20*a* and the second side 22*a* of the sheet of material 12*a*, and extends between the third side 24*a* and the fourth side 26*a* of the sheet of material 12*a*. The third reinforcing element 28*aa*' is disposed near the second side 22*a* of the sheet of material 12*a*, and extends between the third side 24*a* and the fourth side 26*a* of the sheet of material 12*a*.

Figure 12:
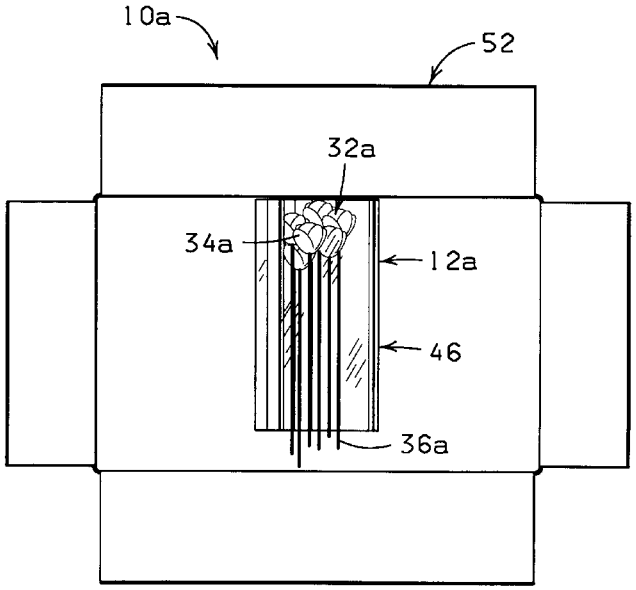
FIG. 12 is a top plan view of the embodiment of FIG. 11, but showing the wrapped floral grouping disposed in a shipping box, the bloom portion of the floral grouping being spaced a distance from the side of the box, the reinforcing elements maintaining said spacing.

The sheet of material 12*a* is utilized to wrap a floral grouping 32*a* by any method shown and/or described herein. The floral grouping 32*a*, after being wrapped, may be disposed in a shipping box 52 for delivery (FIG. 12). The first, second, and third reinforcing elements 28*a*, 28*a*' and 28*aa*', respectively, permit the bloom portion 34*a* of the floral grouping 32*a* to remain spaced slightly away from the side of the shipping box or carton, thereby preventing crushing of the delicate bloom portion 34*a* or the floral grouping 32*a* against the side of the shipping box 52 during shipment and/or delivery.

Figure 13:
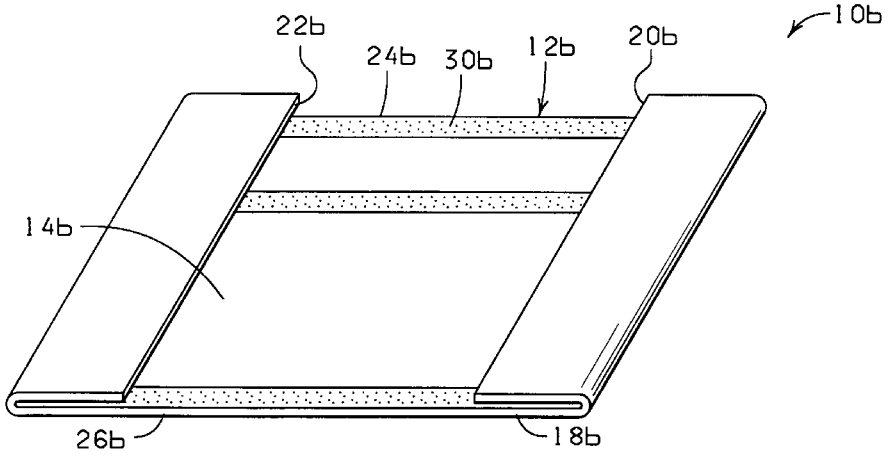
FIG. 13 is a perspective view of yet another embodiment of the wrapping material having reinforcing elements of the present invention, but showing the upper surface, the portions of the sheet of material near the first and second sides being overlapped over other portions of the sheet of material.
Figure 14:
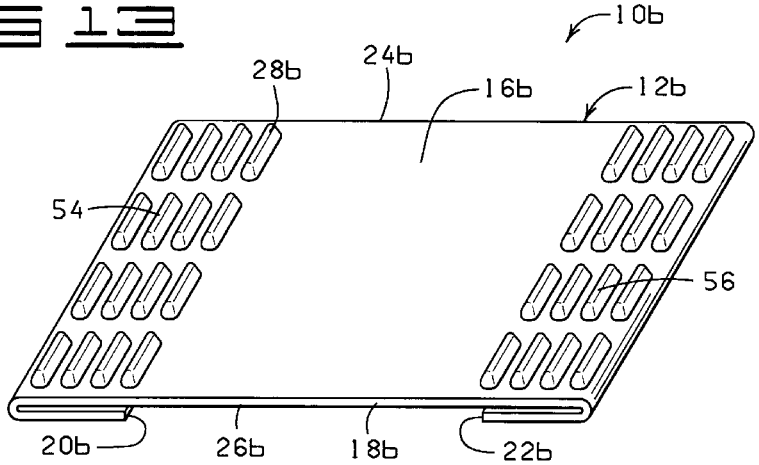
FIG. 14 is a perspective view of FIG. 13 but showing the lower surface of the sheet of material, corrugations formed near the first and second sides of the sheet of material, the corrugations forming the reinforcing elements.
Figure 15:
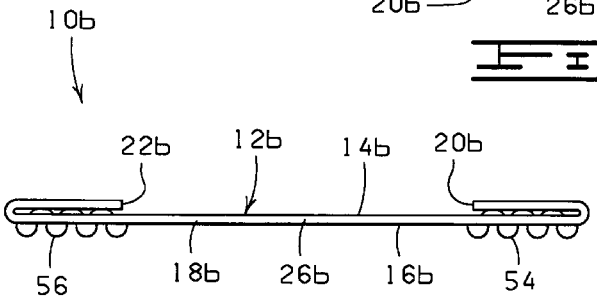
FIG. 15 is a side elevational view of the embodiment of FIG. 13.
Figure 16:
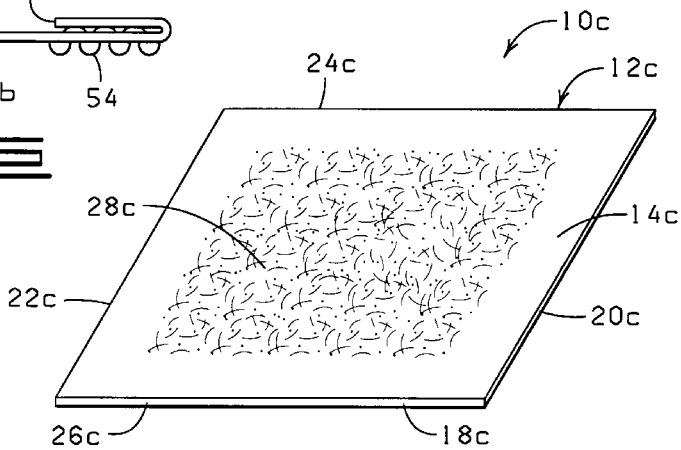
FIG. 16 is a perspective view of still another embodiment of the wrapping material having reinforcing elements of the present invention, but showing the upper surface of the sheet of material having a plurality of reinforcing elements scattered randomly and arbitrarily across the sheet of material.
Figure 17:
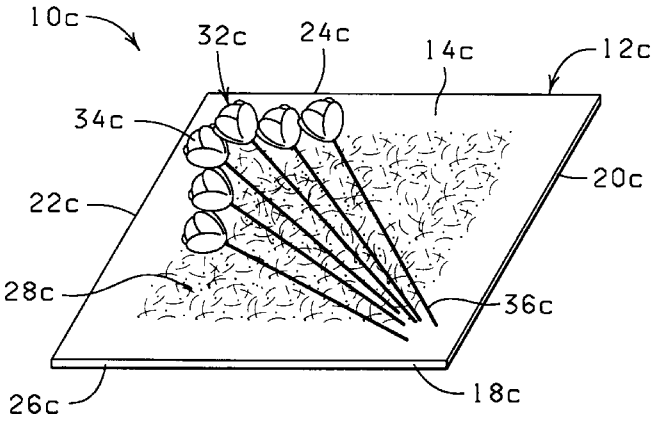
FIG. 17 is a perspective view of the embodiment of FIG. 16, but showing a floral grouping disposed at a diagonal angle thereon.
Figure 18:
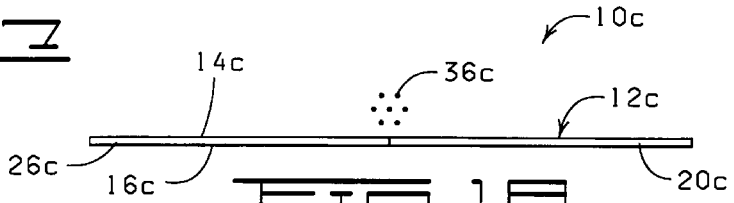
FIG. 18 is a side elevational view of the embodiment of FIG. 17.

The Embodiments and Method of Use of FIGS. 13–15

FIGS. 13–15 illustrate another embodiment and method of use of the present invention. The wrapping material 10*b* shown in this embodiment and used in this method is constructed exactly the same as the wrapping material 10 shown in FIGS. 1–7 and described in detail previously except that the reinforcing elements 28*b* comprise a plurality of reinforcing elements 28*b* (only one such reinforcing element 28*b* being designated) formed from corrugated sections of the sheet of material 12*b* (FIGS. 14–15).

The corrugated sections of the sheet of material 12*b* which form a plurality of reinforcing elements 28*b* are formed by corrugating the sheet of material 12*b* near the first end 20*b* and the second end 22*b*, respectively, of the sheet of material 12*b*. The corrugated section located near the first end of the sheet of material, extending generally between the third side 24*b* and the fourth side 26*b* of the sheet of material 12*b* is the first corrugated section 54, which comprises a plurality of reinforcing elements 28*b*. The corrugated section located near the second side 22*b* of the sheet of material 12*b*, extending generally between the third side 24*b* and the fourth side 26*b* of the sheet of material 12*b* is designated as the second corrugated section 56, and which also comprises a plurality of reinforcing elements 28*b*. The non-corrugated portion of the sheet of material 12*b* near the first side 20*b* overlaps and engagingly contacts and secures the sheet of material 12*b* over the first corrugated section 54. In a similar manner, non-corrugated portion of the sheet of material 12*b* near the second side 22*b* overlaps and engagingly contacts and secures the sheet of material 12*b* over the second corrugated section 56. It will be appreciated that the sheet of material 12*b* is secured to itself as described previously by any method shown and/or described herein, or known in the art.

The sheet of material 12*b* is utilized to wrap a floral grouping 32*b* by any method shown and/or described herein or known in the art. It will be appreciated that the floral grouping 32*b*, after being wrapped, may be disposed in a shipping box (not shown) for delivery.

The Embodiments and Method of Use of FIGS. 16–20

FIGS. 16–20 illustrate another embodiment and method of use of the present invention. The wrapping material 10*c* shown in this embodiment and used in this method is constructed exactly the same as the wrapping material 10 shown in FIGS. 1–7 and described in detail previously except that the reinforcing elements 28*c* comprise a plurality of reinforcing elements 28*c* (only one such reinforcing element 28*c* being designated) disposed on the upper surface 14*c* of the sheet of material 12*c* in a random and arbitrary manner, the plurality of reinforcing elements 28*c* being attached to the sheet of material via a bonding material 30*c* disposed thereupon (not shown), or by any method known in the art, and except that the method of use illustrates a method of forming a frusto-conically shaped wrapper 46. It will be understood that both the distribution and placement of the plurality of reinforcing elements 28*c* on the sheet of material is arbitrary and random. It will be further appreciated that any overlap of portions of the plurality of reinforcing elements 28*c* is in a random and arbitrary manner, that is, there is no set pattern to any overlap of the plurality of reinforcing elements 28*c*.

Figure 19:
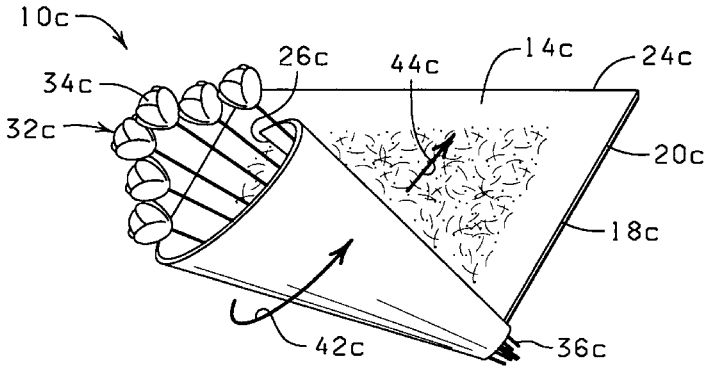
FIG. 19 is a perspective view of the embodiment of FIG. 17, but showing the floral grouping being wrapped.

FIGS. 17–20 show one specific method of use. A sheet of material 12*c* and a floral grouping 32*c*, as described above, are provided. The floral grouping 32*c* is disposed on the sheet of material 12*c*. An operator then lifts a portion of the sheet of material 12*c* (generally the portion near the second side 22*c*) and places the lifted portion over a portion of the floral grouping 32*c* (FIG. 19). In this position, the sheet of material 12*c* is rolled over the floral grouping 32*c*, and the sheet of material 12*c* and the floral grouping 32*c* are then rolled in a rolling direction 42*c* and in a general direction 44*c*, the floral grouping 32*c* being rolled into the sheet of material 12*c*, thereby rolling the sheet of material 12*c* generally about the floral grouping 32*c* and containing and substantially encompassing the floral grouping 32*c* within the sheet of material 12*c*, until the floral grouping 32*c* is disposed generally adjacent the third side 24*c* of the sheet of material 12*c* (FIG. 20). In this position, the operator continues to roll the sheet of material 12*c* and the floral grouping 32*c* disposed therein until the upper surface 14*c* of the sheet of material 12*c* is bondingly connected to adjacent portions of the sheet of material 12*c* thereby securing the sheet of material 12*c* and securely wrapping the floral grouping 32*c* thereby forming a wrapper 46*c*, as shown in FIG. 20.

The sheet of material 12*c* may be utilized to wrap a floral grouping 32*c* by any method shown and/or described herein, or known in the art. It will be understood that the floral grouping 32*c*, after being wrapped, may be disposed in a shipping box (not shown) for delivery.

U.S. Pat. No. 5,181,364, entitled, "Wrapping A Floral Grouping With Sheets Having An Adhesive Or Cohesive Material Applied Thereto", issued to Weder et al. on Jan. 26, 1993, which is hereby incorporated by reference herein, discloses methods of wrapping a floral grouping in a wrapper.

The Embodiments and Method of Use of FIGS. 21–24

FIGS. 21–24 illustrate another embodiment and method of use of the present invention. The wrapping material 10*d* shown in this embodiment and used in this method is constructed exactly the same as the wrapping material 10*c* shown in FIGS. 16–20 and described in detail previously except that the sheet of material 12*d* is formed into a plurality of sheets of material 12*d* which are stacked and aligned one on top of the other to form a pad 58 of sheets of material 12*d*.

The pad 58 comprises a top sheet 60 having a next sheet 62 disposed directly thereunder, with additional sheets of material 12*d* disposed under the next sheet 62, all sheets collectively forming the pad 58 of sheets of material 12*d*. The sheets of material 12*d* are generally aligned, and are connected together via a bonding material (not shown), such as, but not by way of limitation, a pressure sensitive adhesive.

Figure 24:
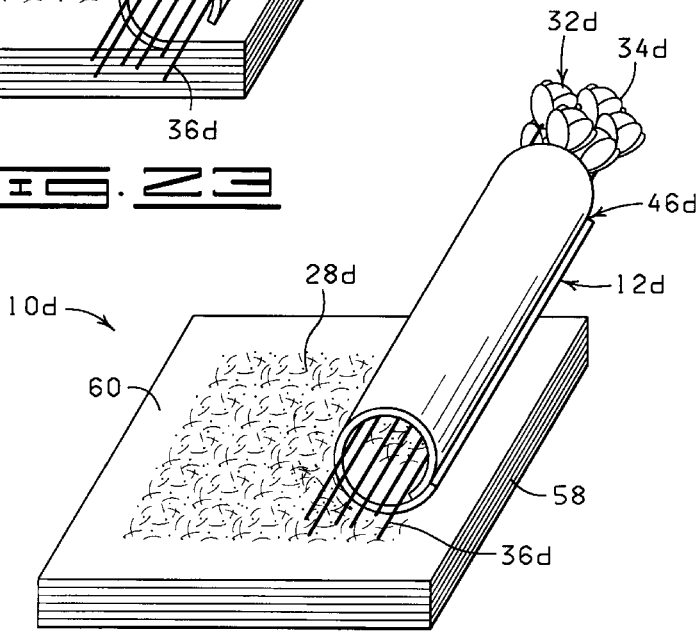
FIG. 24 is a perspective view of the embodiment of FIG. 21, but showing the wrapped floral grouping, and showing the top sheet of material which forms the wrapper being disconnected from the pad.

When the top sheet 60 of material 12*d* is lifted and removed from the pad 58, as shown in FIG. 24, the next sheet 62 becomes the new top sheet 60, and the sheet directly below the new top sheet 60 becomes the new next sheet 62. This process is repeated, until all of the sheets of material 12*d* in the pad 58 are removed.

Figure 22:
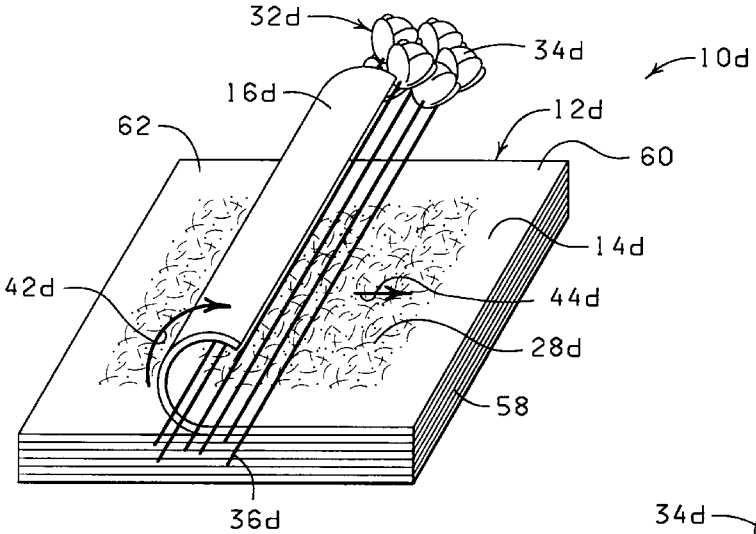
FIG. 22 is a perspective view of the embodiment of FIG. 21, but showing the floral grouping being wrapped.
Figure 23:
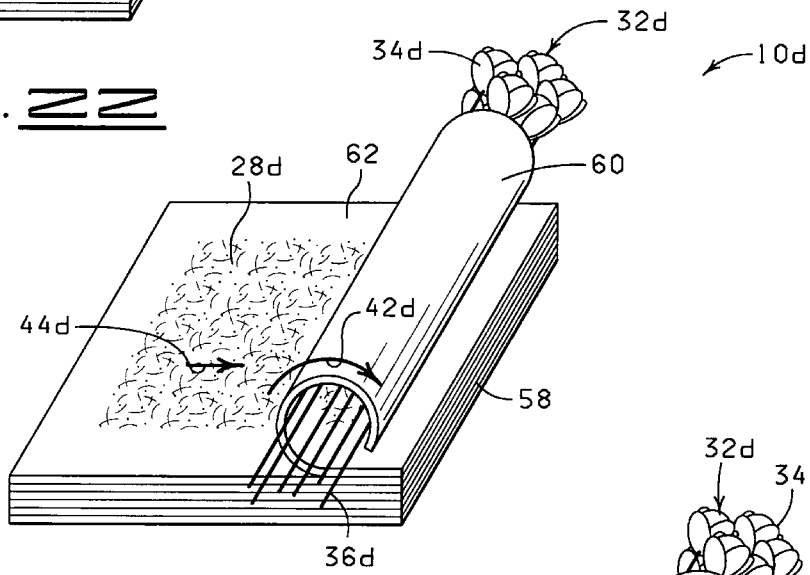
FIG. 23 is a perspective view of the embodiment of FIG. 21, but showing the floral grouping being wrapped.

In a method of operation, a floral grouping 32*d* (or flower pot, now shown) is placed on the top sheet 60 in the pad 58 and the top sheet 60 may be wrapped about the floral grouping 32*d* (or flower pot) and removed from the pad 58, as illustrated in FIGS. 22–24. Methods and means for forming a pad, using the sheets of material to wrap floral groupings, and removing sheets from a pad are known in the art. Methods of both forming a pad and wrapping floral groupings with sheets of material from a pad are described in U.S. Pat. No. 5,181,364, entitled, "Wrapping A Floral Grouping With Sheets Having Adhesive Or Cohesive Material Applied Thereto", issued to Weder on Jan. 26, 1993, which has been previously incorporated by reference herein.

Embodiments of FIGS. 25–30

Referring now to FIGS. 25–30, as noted above, a sheet of material 12 may be used to provide a wrapper termed herein a "decorative cover" 64 for an object such as a flower pot 66 or a potted plant (interchangeably termed "flower pot cover"). The term "flower pot" refers to any type of container used for holding a floral grouping or a potted plant. Examples of flower pots 66 used in accordance with the present invention include, but not by way of limitation, clay pots, plastic pots, wooden pots, pots made from natural and/or synthetic fiber, and the like.

The flower pot 66 has a rigid base 67 comprising an open upper end 68, a closed lower end 70, and an outer peripheral surface 72. An opening 74 intersects the open upper end 68 forming an inner peripheral surface 76 and a retaining space 78.

A modified sheet of material 12*e*, identical to the sheet of material 12*c* or 12*d* as shown in FIGS. 16–20 and FIGS. 21–24, respectively, is provided, except that the sheet of material 12*e* has either a bonding material (not shown) disposed substantially thereon, or is formed at least partially from a shape-sustaining material, or both. To cover the object, the sheet of material 12*e* may be manually or automatically formed about the outer peripheral surface 72 of the pot 66 or potted plant. Or, the sheet of material 12*e* may be formed into a preformed decorative cover 64 which is then placed about the outer peripheral surface 72 of the pot 66 or potted plant.

Figure 25:
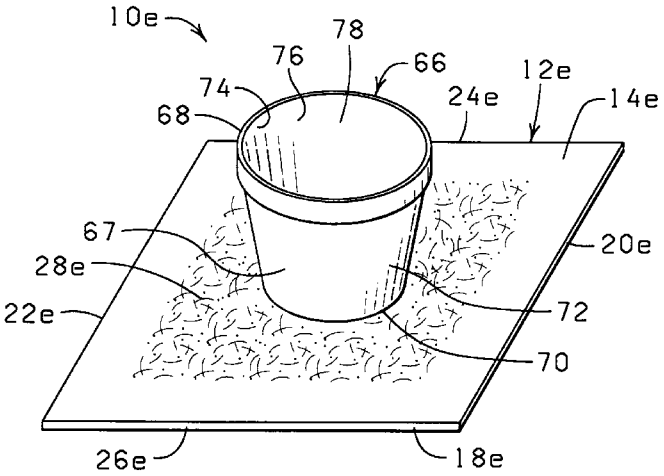
FIG. 25 is a perspective view of the embodiment of FIG. 16, but showing a pot disposed generally in the center of the sheet of material.
Figure 26:
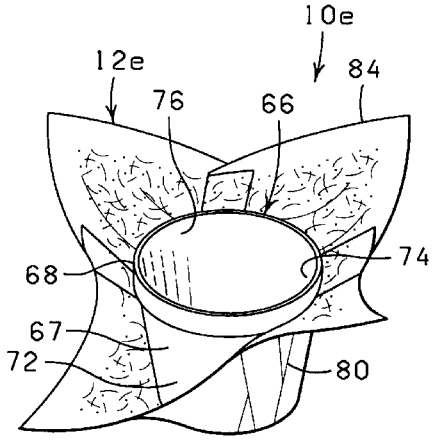
FIG. 26 is a perspective view of the embodiment of FIG. 25, but showing the pot being wrapped.
Figure 27:
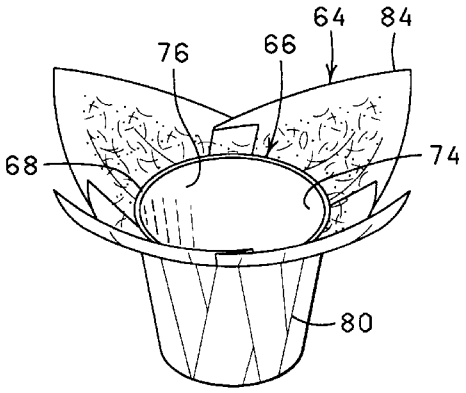
FIG. 27 is a perspective view of the embodiment of FIG. 25, but showing the pot wrapped.

In a method of use, referring to FIGS. 25–27, to form a sheet of material 12*e* into a decorative cover 64 about a pot 66, both a flower pot 66 and a sheet of material 12*e* is provided. The pot 66 is disposed upon the upper surface 14*e* of the sheet of material 12*e*, so that the lower end 70 of the pot 66 rests upon a portion of the upper surface 14*e*.

In one embodiment of a manual application of the sheet of material 12*e* about the pot 66, the upper surface 14*e* of the sheet of material 12*e* is formed about the outer peripheral surface 72 of the pot 66 (FIGS. 26–27), thereby engaging the outer peripheral surface 72 of the pot 66 to form a decorative cover 64 about the pot 66 as shown in FIG. 27, in a manner which is known to those having ordinary skill in the art. The lower surface 16*e* of the sheet of material 12*e* thereby becomes the outer surface 80 of the decorative cover 64.

Another method for wrapping the sheet of material 12*e* about a pot 66 for forming such a decorative cover 64 is shown in U.S. Pat. No. 4,733,521, entitled, "Cover Forming Apparatus", issued to Weder et al., on Mar. 29, 1988, which is hereby incorporated herein by reference. A decorative cover 64 formed by wrapping the sheet of material 12*e* about the flower pot 66 may be secured to the outer peripheral surface 72 of the pot 66 by the use of one or more bonding materials described herein, such banding material applied generally to the outer surface 80 of the decorative cover 64. One particular method of securing the decorative cover 64 to the pot 66 is by applying a band (not shown) about the pot 66 to hold the decorative cover 64 in place such as is described in U.S. Pat. No. 5,105,599, entitled "Means For Securing A Decorative Cover About A Flower Pot", issued to Weder on Apr. 21, 1992 and which is hereby incorporated herein by reference.

The term "band" when used herein means any material which may be secured about an object such as a flower pot, such bands commonly being referred to as elastic bands, rubber bands or non-elastic bands and also includes any other type of material such as an elastic or non-elastic string or elastic piece of material, non-elastic piece of material, a round piece of material, a flat piece of material, a ribbon, a piece of paper strip, a piece of plastic strip, a piece of wire, a tie wrap or a twist tie or combinations thereof or any other device capable of gathering the sheet of material to removably or substantially permanently form a crimped portion and secure the crimped portion formed in the sheet of material which may be secured about an object such as the flower pot. The band also may include a bow if desired in a particular application.

Figure 28:
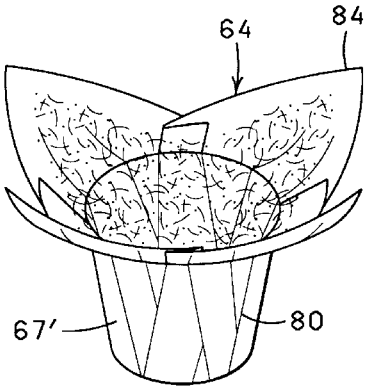
FIG. 28 is a perspective view of the embodiment of FIG. 16, but showing the sheet of material preformed into a decorative plant and/or pot cover.
Figure 29:
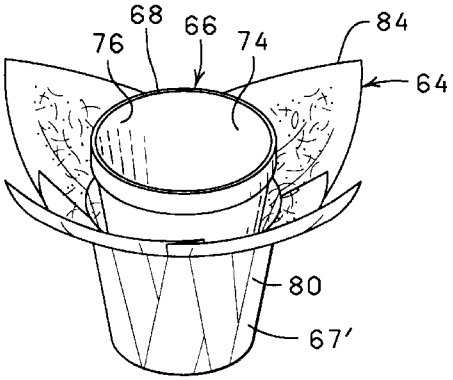
FIG. 29 is a perspective view of the embodiment of FIG. 28, but showing a pot being disposed into the preformed plant cover.
Figure 30:
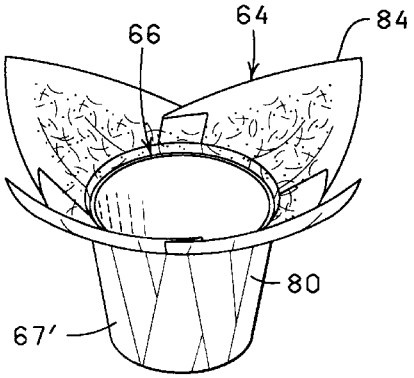
FIG. 30 is a perspective view of the embodiment of FIG. 28, but showing a pot disposed in the preformed plant cover.

Alternatively, the sheet of material 12*e* may be preformed into a decorative cover 64 having an opening 74 as shown in FIGS. 28–30. The decorative cover 64 may be formed from a flexible material, and form a gift wrapped appearance about the pot 66. The decorative cover 64 may also be formed such that the cover 64 is self-supporting by virtue of overlapping folds, or pleats, thereby forming a rigid structure, as shown in FIGS. 28–30, sufficient to act as a temporary or permanent container for a pot 66 or a floral grouping 32*e* or plant disposed in a growing medium. It will be appreciated that the self-supporting decorative cover 64 has the same structural features as those previously described for a pot 66. A plant (not shown) and a growing medium can be disposed into the opening of the preformed cover 64, thereby resulting in a decoratively covered plant, with the use of a separate pot (not shown). That is, the decorative preformed cover 64 may be used as a pot 66. It will be appreciated, however, that some preformed decorative covers 64 may not be rigidly formed, and will operate only as a decorative cover 64, said cover 64 lacking sufficient rigidity to function as a pot or container.

One method for forming such a preformed decorative plant or pot cover is shown in U.S. Pat. No. 4,773,182, entitled, "Article Forming System", issued to Weder et al. on Sep. 27, 1988, which is hereby incorporated herein by reference.

The decorative cover 64 may comprise a skirt 84, shown in FIGS. 26–30 as a four-cornered extension extending a distance away from the base 67'. It will be appreciated that the skirt 84 and/or the base 67' may comprise any geometric, non-geometric, asymmetric and/or fanciful shape, pattern and/or design.

The term "plant" or "potted plant" (not shown) as used herein means a plant having a bloom or foliage portion and a stem portion as well as a root portion, the root portion disposed in a growing medium. The term "plant" or "potted plant" as used herein also includes botanical items and propagules.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

Figure 31:
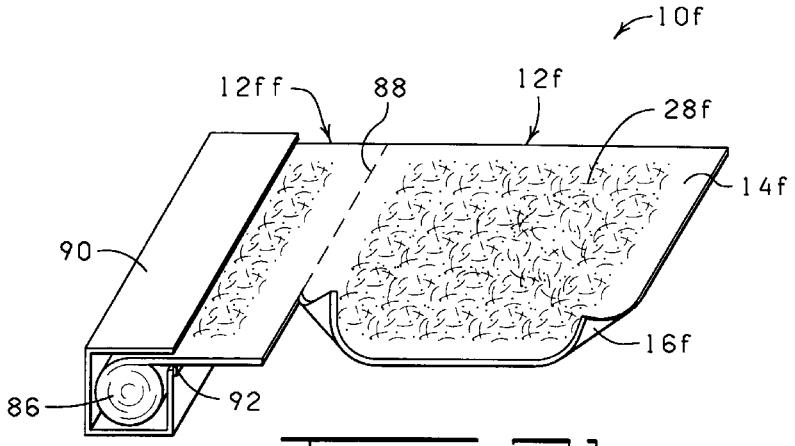
FIG. 31 is a perspective view of the embodiment of FIG. 16, but showing a plurality of sheets of material contained within a roll, the roll being contained within a dispenser, a portion of a sheet of material being partially detached from another sheet of material.
Figure 32:
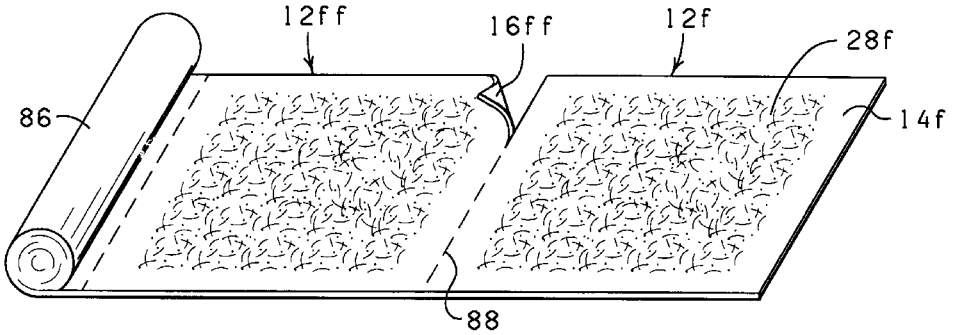
FIG. 32 is a perspective view of the embodiment of FIG. 16, but showing a plurality of sheets of material contained within a roll, a portion of one sheet of material being partially detached from the adjacent sheet of material.
Figure 33:
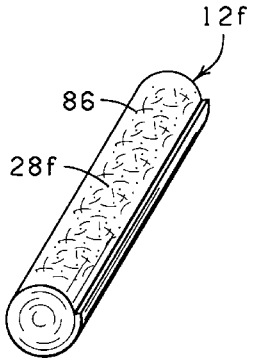
FIG. 33 is a perspective view of the embodiment of FIG. 16, but showing a single sheet of material formed into a roll.

Embodiments of FIGS. 31–33

Referring now to FIGS. 31–33, a modified sheet of material 12*f* is shown. The sheet of material 12*f* is identical to the sheet of material 12*c*, 12*d*, and 12*e* shown in FIGS. 16–20, 21–24, and 25–30, respectively, and described in detail previously, except that the sheet of material 12*f* is formed into a plurality of individual sheets of material 12*f* which are connected linearly together to form a roll 86. Frequently, the plurality of sheets of material 12*f* in the roll 86 are connected by perforations 88, as illustrated in FIGS. 31–32. Such a roll 86 permits one sheet of material 12*f* to be withdrawn from the roll 86, then severed or disconnected from the roll 86. Alternatively, the roll 86 may simply be formed as a continuous roll 86 of wrapping material 10*f* without perforations (not shown), wherein a plurality of sheets of material 12*f* may be removed from the roll 86 by unrolling a portion of the roll 86, and using a separate cutting element (not shown) to sever the unrolled portion of the roll 86 of material to form the sheet of material 12*f*. The roll 86 may also be contained within a dispenser 90, as illustrated in FIG. 31. When the roll 86 is disposed in the dispenser 90, a portion of the material is again unrolled, and a serrated cutting edge 92 contained within the dispenser 90, or a separate cutting element (not shown), severs the unrolled portion of the material from the roll 86 to form a sheet of material 12*f*. Any number of sheets of material 12*f* may form a roll 86 as long as it is possible to withdraw at least one sheet of material 12*f* from the roll 86 as described herein. A roll 86 formed by one sheet of material 12*f* is shown in FIG. 33.

It will be appreciated that the plurality of reinforcing elements 28*f* may extend throughout the roll 86 of material, including through the perforations 88 (not shown). It will also be understood that the plurality of reinforcing elements 28*f* may be disposed on the upper surface 14*f*, and lower surface 16*f*, or both (not shown).

Figure 34:
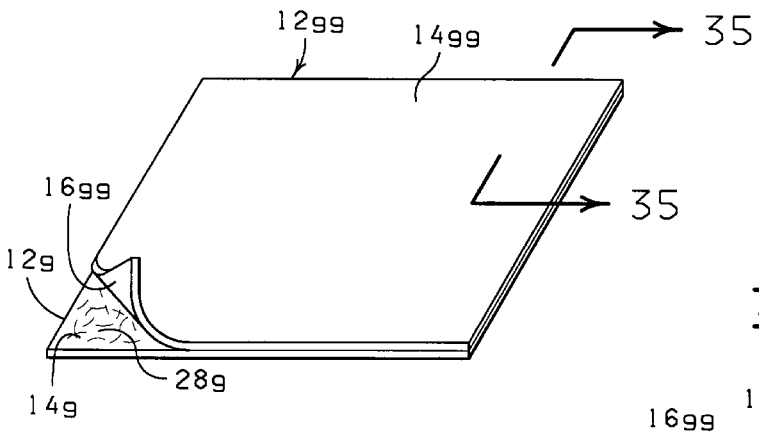
FIG. 34 is a perspective view of still yet another embodiment of the wrapping material having reinforcing elements of the present invention, but showing a first sheet of material similar to the embodiment of FIG. 16 having reinforcing elements thereon with a second sheet of material connected over the first sheet of material, the reinforcing elements disposed between the first and second sheets of material.
Figure 35:
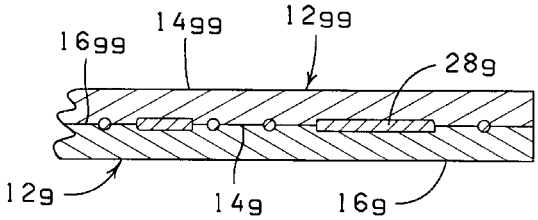
FIG. 35 is an enlarged cross-sectional partial view of FIG. 34 taken along the lines 35—35 of FIG. 34, showing the reinforcing elements disposed between the first and second sheets of material.

The Embodiments and Method of Use of FIGS. 34–35

FIGS. 34–35 illustrate another embodiment and method of use of the present invention. The wrapping material 10*g* shown in this embodiment and used in this method is constructed exactly the same as the wrapping material 10*c*, 10*d*, 10*e* and 10*f* shown in FIGS. 16–20, 21–24, 25–30 and 31–33, respectively, and described in detail previously except that the sheet of material 12*g* further comprises a second sheet of material 12*gg* which is connected to the upper surface 14*g* of the first sheet of material 12*g*, and the plurality of reinforcing elements 28*g* disposed on the upper surface 14*g* of the first sheet of material 12*g* are covered by the lower surface 16*gg* of the second sheet of material 12*gg*. It will be understood that the second sheet of material 12*gg* has all of the same structural features previously described herein for the first sheet of material 12*g*, except that the second sheet of material 12*gg* may, optionally, not comprise a plurality of reinforcing elements 28*g* and/or a bonding material. Alternatively, however, it will be understood that the second sheet of material 12*gg* may comprise either a plurality of reinforcing elements on any surface or combination of surfaces or a bonding material on any surface or combination of surfaces, or both a plurality of reinforcing elements and a bonding material. The first sheet of material 12*g* and the second sheet of material 12*gg* may be laminated together, bonded together, or connected by any method shown and/or described herein or known in the art. A bonding material (not shown) may be utilized on one or more surfaces of the first sheet of material 12*g* and/or the second sheet of material 12*gg*. Alternatively, the exposed surfaces of the first and second sheets of material 12*g* and 12*gg*, respectively, may be free from a bonding material.

It will be understood that the sheets of material 12*g* and 12*gg* are utilized to wrap a floral grouping, a flower pot, or a plant in a growing medium by any method shown and/or described herein, or known in the art.

Changes may be made in the embodiments of the invention described herein or in parts or elements of the embodiments described herein or in the steps or in the sequences of steps of the methods described herein without departing from the spirit and scope of the invention as defined in the following claims.

What is claimed is:

1. A wrapper for wrapping a floral item, comprising:

a wrapping material comprising a non-shape sustaining sheet of material having an upper surface, a lower surface and an outer periphery, the sheet of material having a plurality of reinforcing elements extending across a portion of the sheet of material, the sheet of material being sized and shaped for being wrapped about a floral item to form a protective wrapper; and a floral item selected from the group consisting of a floral grouping and a flower pot;

wherein the plurality of reinforcing elements permit the sheet of material to sustain a shape when wrapped about the floral item, and wherein when the sheet of material is wrapped about the floral item, the plurality of reinforcing elements hold the sheet of material in the wrapped shape, thereby forming the wrapper about the item, the wrapper having a lower end selected from the group consisting of an open lower end and a closed, seamless, unfolded lower end.

2. The wrapper of claim 1 wherein the wrapper further comprises means for connecting the plurality of reinforcing elements to the sheet of material.

3. The wrapper of claim 1 wherein the sheet of material has a thickness in a range from about 0.1 mil to about 30 mils.

4. The wrapper of claim 1 wherein the sheet of material is further defined as comprising a material selected from the group consisting of paper, cellophane, foil, polymer film, cellulose, fiber, cloth, burlap and any combinations thereof.

5. A wrapper for wrapping about a floral item, comprising:

a floral item selected from the group consisting of a floral grouping and a flower pot;

a wrapping material comprising a non-shape sustaining sheet of material comprising a polymer film having a plurality of reinforcing elements;

wherein the plurality of reinforcing elements permit the wrapping material to sustain and hold a shape when the wrapping material is wrapped about the floral item to form the wrapper, the wrapper having a lower end selected from the group consisting of an open lower end and a closed, seamless, unfolded lower end.

6. The wrapper of claim 5 wherein at least a portion of the reinforcing elements overlap each other.

7. The wrapper of claim 5 wherein a substantial portion of the reinforcing elements overlap each other.

8. The wrapper of claim 5 wherein the sheet of material has a thickness in a range from about 0.1 mil to about 30 mils.

9. The wrapper of claim 5 wherein the sheet of material is further defined as comprising a material selected from the group consisting of paper, cellophane, foil, polymer film, cellulose, fiber, cloth, burlap and any combination thereof.

10. The wrapper of claim 5 wherein the wrapper further comprises means for connecting the plurality of reinforcing elements to the sheet of material.

* * * * *

UNITED STATES PATENT AND TRADEMARK OFFICE

CERTIFICATE OF CORRECTION

PATENT NO. : 5,975,299 
APPLICATION NO. : 08/452911
DATED : November 2, 1999
INVENTOR(S) : Donald E. Weder and Joseph G. Straeter It is certified that error appears in the above-identified patent and that said Letters Patent is hereby corrected as shown below:

Title Page, "Related U.S. Application Data", [63], please amend as follows:

Line 20 - After the word, "abandoned", delete ", which is".

Line 28 - After the numeral, "07/219,083", insert --now U.S. Patent No. 4,897,031--.

Lines 37 and 38 - After the numeral, "07/249,761", insert --filed September 26, 1988, now abandoned,--.

Col. 6, Line 17 - Delete the word "of" and substitute therefore the word --or--.

Col. 7, Line 10 - Delete the word "not" and substitute therefore the word --be--.

Col. 8, Line 44 - Delete the word "reinfocing" and substitute therefore the word --reinforcing--.

Col. 9, Line 46 - Delete the word "of" and substitute therefore the word --or--.

Col. 9, Line 59 - Delete the word "appreciate" and substitute therefore the word --appreciated--.

Col. 12, Line 7 and 8 - Delete the phrase "open lower end" and substitute therefore the phrase --lower end 50--.

Signed and Sealed this

Thirty-first Day of July, 2007

JON W. DUDAS
*Director of the United States Patent and Trademark Office*